US012571282B2

(12) United States Patent
Balhareth et al.

(10) Patent No.: US 12,571,282 B2
(45) Date of Patent: Mar. 10, 2026

(54) DOWNHOLE FLUID LOSS REPAIR

(71) Applicant: Saudi Arabian Oil Company, Dhahran (SA)

(72) Inventors: Turki M. Balhareth, Dammam (SA); Abdullah E. Noaimi, Dammam (SA); Abdulaziz D. Alqahtani, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/615,483

(22) Filed: Mar. 25, 2024

(65) Prior Publication Data

US 2025/0297527 A1 Sep. 25, 2025

(51) Int. Cl.

| | |
|---|---|
| ***E21B 33/138*** | (2006.01) |
| ***E21B 23/06*** | (2006.01) |
| ***E21B 33/134*** | (2006.01) |
| ***E21B 34/06*** | (2006.01) |
| ***E21B 34/14*** | (2006.01) |
| ***E21B 47/117*** | (2012.01) |

(52) U.S. Cl.

CPC ..... *E21B 33/138* (2013.01); *E21B 23/06* (2013.01); *E21B 33/134* (2013.01); *E21B 34/063* (2013.01); *E21B 34/142* (2020.05); *E21B 47/117* (2020.05)

(58) Field of Classification Search

CPC .... E21B 33/138; E21B 33/134; E21B 47/117; E21B 34/142; E21B 34/063; E21B 23/06

See application file for complete search history.

(56) References Cited

U.S. PATENT DOCUMENTS 2,855,943 A * 10/1958 Moller ..... E21B 34/14 166/317
3,791,449 A * 2/1974 Cochran ..... E21B 34/142 175/3
4,969,524 A * 11/1990 Whiteley ..... E21B 34/142 166/278

(Continued)

FOREIGN PATENT DOCUMENTS

CA 3158008 A1 11/2023

OTHER PUBLICATIONS

International Search Report and Written Opinion in International Appln. No. PCT/US2025/021260, mailed on Jun. 27, 2025, 15 pages.

*Primary Examiner* — Aaron L Lembo
(74) *Attorney, Agent, or Firm* — Fish & Richardson P.C.

(57) ABSTRACT

A downhole well tool includes a tubing including a circulation fluid pathway, a first packer, and a second packer positioned longitudinally apart from the first packer. The well tool includes a circulation sub connected to the tubing on a first longitudinal side of the second packer, the circulation sub including a first circulation port to fluidly couple the circulation fluid pathway to an annulus of the wellbore, and a plug seat positioned in the fluid circulation pathway. A second circulation port in the tubing is positioned longitudinally between the first packer and the second packer, and fluidly couples the circulation fluid pathway to the annulus of the wellbore between the first packer and the second packer. The second circulation port includes a frangible cover that plugs the second circulation port and ruptures in response to a burst pressure in the circulation fluid pathway.

18 Claims, 6 Drawing Sheets

(56) References Cited

U.S. PATENT DOCUMENTS

| | | | | |
|---|---|---|---|---|
| 5,109,925 | A * | 5/1992 | Stepp | E21B 33/146 166/324 |
| 5,526,878 | A * | 6/1996 | Duell | E21B 33/127 166/187 |
| 6,269,878 | B1 * | 8/2001 | Wyatt | E21B 23/06 166/185 |
| 7,909,096 | B2 * | 3/2011 | Clark | E21B 33/124 166/305.1 |
| 8,167,047 | B2 * | 5/2012 | Themig | E21B 43/16 166/317 |
| 8,863,853 | B1 * | 10/2014 | Harris | E21B 34/06 166/383 |
| 9,010,442 | B2 * | 4/2015 | Streich | E21B 34/102 166/376 |
| 9,441,467 | B2 * | 9/2016 | Harris | E21B 43/12 |
| 9,458,698 | B2 * | 10/2016 | Harris | E21B 34/14 |
| 9,581,003 | B2 * | 2/2017 | Kofoed | E21B 33/12 |
| 9,915,122 | B2 * | 3/2018 | Hofman | E21B 34/103 |
| 10,280,706 | B1 | 5/2019 | Sharp, III | |
| 10,494,900 | B2 * | 12/2019 | Cleven | E21B 43/16 |
| 10,837,254 | B2 | 11/2020 | Al-Mousa et al. | |
| 10,883,336 | B2 * | 1/2021 | Prieur | E21B 33/13 |
| 10,982,504 | B2 * | 4/2021 | Al-Mousa | E21B 43/112 |
| 10,982,538 | B2 * | 4/2021 | Tiwari | E21B 34/06 |
| 11,091,983 | B2 * | 8/2021 | Costa De Oliveira | E21B 21/08 |
| 11,162,325 | B2 * | 11/2021 | Tunes | E21B 29/08 |
| 11,168,534 | B2 * | 11/2021 | El-Zefzafy | E21B 33/12 |
| 11,313,198 | B2 * | 4/2022 | Elliott | E21B 29/02 |
| 11,391,113 | B2 | 7/2022 | Al-Mousa et al. | |
| 11,401,778 | B1 * | 8/2022 | Saraya | E21B 17/08 |
| 11,473,397 | B2 | 10/2022 | Egbe et al. | |
| 11,480,025 | B2 * | 10/2022 | Jones | E21B 33/13 |
| 11,578,560 | B2 * | 2/2023 | Zavala | E21B 33/128 |
| 2008/0277119 | A1 * | 11/2008 | Hill, Jr. | E21B 34/101 166/305.1 |
| 2017/0058643 | A1 | 3/2017 | Snider et al. | |
| 2023/0116346 | A1 * | 4/2023 | Dave | E21B 23/06 166/387 |
| 2023/0125323 | A1 * | 4/2023 | Al-Mousa | E21B 29/002 166/298 |
| 2024/0084668 | A1 * | 3/2024 | Al-Ghamdi | E21B 33/16 |
| 2024/0093572 | A1 * | 3/2024 | Al-Mousa | E21B 34/142 |

* cited by examiner

DOWNHOLE FLUID LOSS REPAIR

TECHNICAL FIELD

This disclosure relates to downhole well tools, and more particularly to downhole leak curing tools for casing leaks in wellbores.

BACKGROUND

Drilling and production operations of a hydrocarbon well require control of a downhole wellbore environment. Fluid leaks in downhole wellbore environments can cause operational problems, safety hazards, or delays to a producing well or a well being drilled, which can be expensive and time-consuming to address. Well treatment systems that address fluid leaks often require well intervention and workover, or valve tools formed in a well string.

SUMMARY

This disclosure describes downhole well tools for curing wellbore leaks.

Some aspects of the disclosure encompass a downhole well tool including a tubing to be disposed in a wellbore along a longitudinal axis of the tubing, where the tubing includes a circulation fluid pathway through an interior of the tubing. The well tool includes a first packer circumscribing a first portion of the tubing, and a second packer circumscribing a second portion of the tubing. The first packer is positioned longitudinally apart from (for example, uphole of) the second packer on the tubing, and the first packer and the second packer can selectively engage and seal against a wall of the wellbore. The downhole well tool includes a circulation sub connected to the tubing on a first longitudinal side of (for example, downhole of) the second packer, where the circulation sub includes a first circulation port to fluidly couple the circulation fluid pathway to an annulus of the wellbore on the first longitudinal side of (for example, downhole of) the second packer, and a plug seat positioned in the fluid circulation pathway, such as downhole of the first circulation port. The plug seat can seal against a dropped plug within the tubing. A second circulation port in the tubing is positioned longitudinally between the first packer and the second packer, and fluidly couples the circulation fluid pathway to the annulus of the wellbore between the first packer and the second packer. The second circulation port includes a frangible cover to selectively plug the second circulation port, where the frangible cover ruptures in response to a pressure in the circulation fluid pathway greater than a burst pressure threshold.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
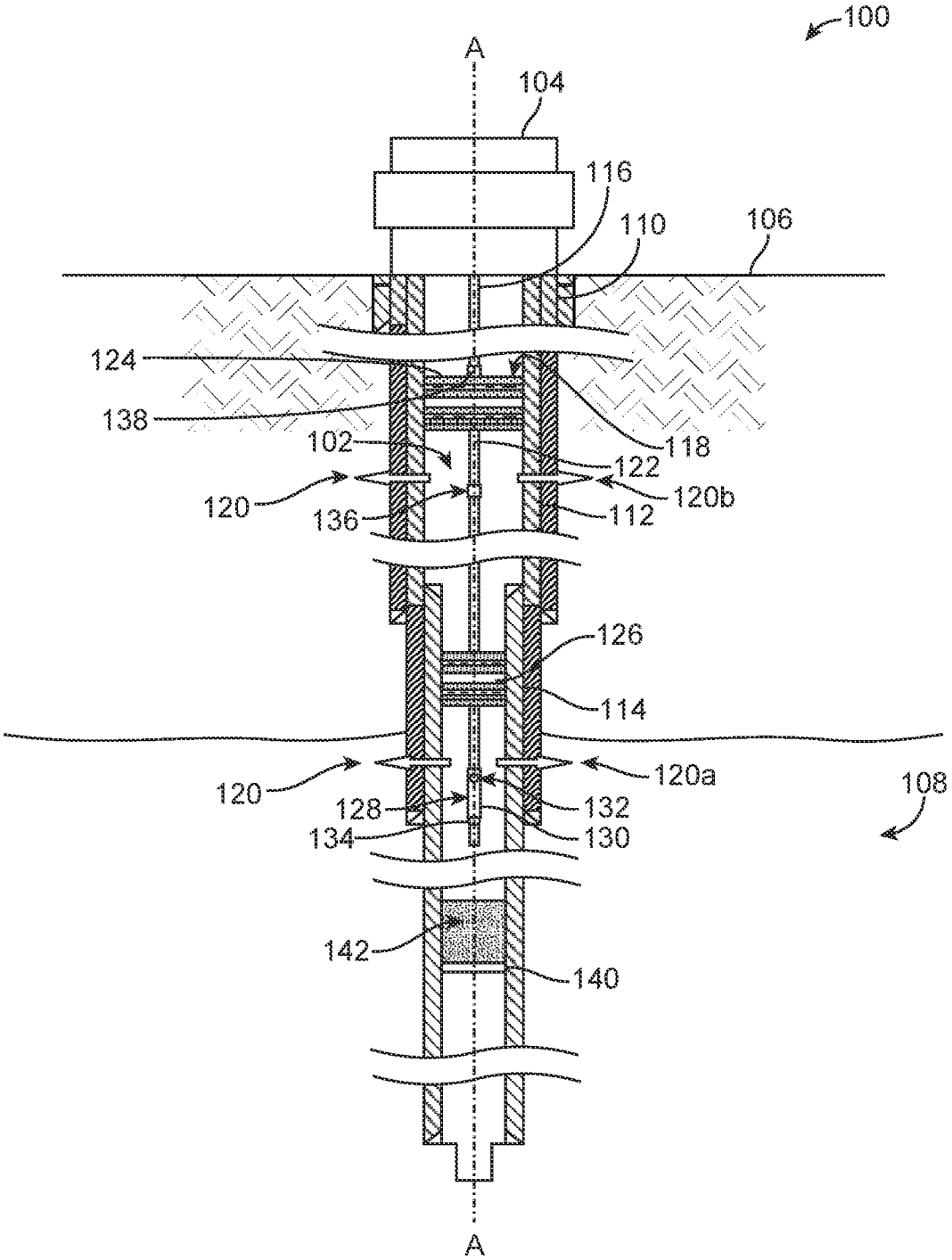
FIG. 1 is a schematic partial cross-sectional side view of an example well system including a downhole well tool carried on a well string.

This disclosure describes well tools, such as downhole cementing tools, for repairing or scaling multiple leaks in a wellbore in a single run. The downhole well tool includes a drillable tubing and multiple longitudinally spaced packers along the tubing made from a drillable material. For example, the drillable tubing can include non-metallic drill pipe, and the packers can include drillable brass packers. The well tool includes circulation ports for selectively injecting a cementing fluid into wellbore zones between adjacent packers of the multiple inflatable packers, downhole of the packers, or both. In an example operation, the multiple packers of the well tool are simultaneously set, and cementing fluid is circulated through a circulation fluid pathway through the tubing and pumped into the wellbore through the circulation ports, starting from a lowermost circulation port to an uppermost circulation port. In some instances, the downhole well tool includes a disconnect sub that, after cementing operations are complete, can separate the well tool from a well string uphole of the packers. Disconnecting the well tool from an uphole well string allows for a drilling tool to drill out the well tool to regain access to the wellbore.

The well tool of the present disclosure allows for multiple leaks in a wellbore wall(s) to be cured in a single run into the wellbore. For example, packers isolate the multiple leak intervals, and cementing fluid is directed to leak areas sequentially, starting from a downhole circulation port and moving uphole to sequential circulation ports. Because the components of the well tool are drillable, the well tool can be drilled through after a cementing operation that seals leaks in the wellbore wall(s), such that the well tool does not hamper future operations in the wellbore at or downhole of the longitudinal depth of the well tool. Well tools of the present disclosure can simplify leak repair operations and save considerable time and cost.

In some implementations, the well tool includes a circulation sub connected to the tubing downhole of the lowermost packer, and the circulation sub includes a sliding sleeve valve, a plug seat formed in the sliding sleeve valve, and a first circulation port fluidly coupling the circulation fluid pathway to an annulus of the wellbore. The first circulation port is plugged by the sliding sleeve valve in a first, closed position of the sliding sleeve valve, and can be opened to fluid flow following a movement of the sliding sleeve valve from the first position to a second, open position. In some examples, the tubing includes a second circulation port positioned uphole of the lowermost packer, such as longitudinally between two adjacent packers, and the second circulation port includes a frangible cover that selectively plugs the second circulation port from fluid flow between the circulation fluid pathway and the wellbore annulus between the well tool and the wellbore wall(s). The frangible cover is configured to rupture in response to a pressure in the circulation fluid pathway that is greater than a burst pressure threshold of the frangible cover.

In some implementations, a plug seat is dropped from a surface of a well and is run through a well string to the plug seat of the circulation sub. Once the plug seat engages with and seals to the plug seat, the circulation fluid pathway can be pressurized to various pressures, for example, to initiate different operations of the well tool. For example, at a first pressure threshold in the circulation fluid pathway, the multiple packers can be set (for example, simultaneously or sequentially). At a second pressure threshold greater than the first pressure threshold, the sliding sleeve valve can be activated, or translated, to open a first circulation port or first set of circulation ports. At a third pressure threshold greater than the second pressure threshold, the frangible cover of a second circulation port or second set of circulation ports can rupture, for example, to open the second circulation port or second set of circulation ports to fluid flow. Additional or different operations of the tool can occur at these or other pressure thresholds.

FIG. 1 is a schematic partial cross-sectional side view of an example well system 100 that includes a substantially cylindrical wellbore 102 extending from a wellhead 104 at a surface 106 downward into the Earth into one or more subterranean zones of interest. In the example well system 100 of FIG. 1, one subterranean zone of interest 108 is shown. The well system 100 includes a vertical well, with the wellbore 102 extending substantially vertically from the surface 106 to the subterranean zone of interest 108. The concepts described here, however, are applicable to many different configurations of wells, including vertical, horizontal, slanted, or otherwise deviated wells.

After some or all of the wellbore 102 is drilled, a portion of the wellbore 102 extending from the wellhead 104 to the subterranean zone 108 can be lined with lengths of tubing, called casing or liner. The wellbore 102 can be drilled in stages, and a casing may be installed between stages. In the example well system 100 of FIG. 1, the wellbore 102 is shown as having been drilled in multiple stages (for example, three stages), with a first casing 110 at a first stage, a second casing 112 at a second stage, and a third casing 114 at a third stage. The first casing 110 is defined by lengths of tubing lining a first portion of the wellbore 102, the second casing 112 is defined by lengths of tubing lining a second portion of the wellbore 102, and the third casing 114 is defined by lengths of tubing lining a third portion of the wellbore 102. The first casing 110 and second casing 112 are shown as extending only partially down the wellbore 102, and the third casing 114 is shown as extending into the subterranean zone of interest 108; however, the first casing 110, second casing, third casing 114, or a combination of these, can extend further into the wellbore 102 or end further uphole in the wellbore 102 than what is shown schematically in FIG. 1. The third casing 114 is shown as extending only partially along the wellbore 102 downhole of the second casing 112; however, the third casing 114 can extend further into the wellbore 102 or end further uphole in the wellbore 102 than what is shown schematically in FIG. 1. While FIG. 1 shows the example well system 100 as including three casings (first casing 110, second casing 112, and third casing 114), the well system 100 can include more casings or fewer casings, such as one, two, four, or more casings. In some examples, the well system 100 excludes casings, and the wellbore 102 is at least partially or entirely open bore.

The wellhead 104 defines an attachment point for other equipment of the well system 100 to attach to the well 102. For example, the wellhead 104 can include a Christmas tree structure including valves used to regulate flow into or out of the wellbore 102. In the example well system 100 of FIG. 1, a tubing string 116 is shown as having been lowered from the wellhead 104 at the surface 106 into the wellbore 102. In some instances, the tubing string 116 includes a series of jointed lengths of tubing coupled end-to-end or a continuous (or, not jointed) coiled tubing. The tubing string 116 is shown in FIG. 1 as a workover string, but the tubing string 116 can alternatively make up a drill string, work string, production string, testing string, or other well string with a well tubing used during the lifetime of the well system 100. The tubing string 116 can include a number of different well tools that can test, produce, intervene, or otherwise engage the wellbore 102.

In the example well system 100 of FIG. 1, the tubing string 116 connects to and supports a downhole well tool 118 for sealing multiple leaks 120 (two shown) through an inner wall of the wellbore 102, such as through one or more of the casings or open bore portions of the example well system 100. For example, the example well system 100 includes a first casing leak 120*a* through the third casing 114 and a second casing leak 120*b* through the second casing 112. The leaks 120 can introduce unwanted fluid flow into or out of the wellbore 102, such as between the wellbore 102 and a surrounding formation. The example well system 100 can include additional or different wellbore leaks 120, through any one of the casings or open hole portions of the wellbore 102, and at different longitudinal locations than the leaks 120 shown in the example well system 100 of FIG. 1. The surface that defines the inner wall of the wellbore 102 can vary, for example, based on the type of well, the depth of the wellbore 102, a combination of these, or other factors. In some instances, the inner wall of the wellbore 102 includes the inner wall of the third casing 114, though the inner wall of the wellbore 102 can be different. For example, the inner wall of the wellbore 102 can include an inner wall of the first casing 110, an inner wall of the second casing 112, the inner wall of the third casing 114, an inner wall of an open bore portion of the wellbore 102, a different surface wall of the wellbore 102, or a combination of these walls.

The downhole well tool 118 of the example well system 100 can operate to seal one or both of the leaks 120*a*, 120*b* in a single run in of the tubing string 116. The downhole well tool 118 is disposed within the wellbore 102, and the components of the downhole well tool 118 are made from non-metallic, drillable materials. As such, the downhole well tool 118 is rugged enough to withstand the harsh environment of the wellbore 102 (for example, due to the presence of caustic fluids, pressure extremes, and temperature extremes in the downhole environment) while also being drillable (for example, by a drill bit on a drill string).

The well tool 118 of the example well system 100 includes a tubing 122 with a circulation fluid pathway through an interior of the tubing 122. The circulation fluid pathway can fluidly connect to the tubing string 116 and to the wellhead 104, for example, to circulate fluid to the downhole well tool 118. The circulated fluid can include cementing fluid, sealant, or other fluid materials. The example well tool 118 includes a first packer 124 circumscribing a first portion of the tubing 122, and a second packer 126 circumscribing a second portion of the tubing 122. The first packer 124 is positioned longitudinally apart from the second packer 126 on the tubing 122, for example, uphole of the second packer 126, and the first packer 124 and the second packer 126 can be activated to engage and seal against the wall of the wellbore 102. In the example well tool 118 of FIG. 1, the first, upper packer 124 is positioned longitudinally uphole of the second, lower packer 126 along the tubing 122. The longitudinal length between the first packer 124 and the second packer 126 can vary, and the example well tool 118 can include additional packers along the tubing 122.

The example well tool 118 also includes a circulation sub 128 connected to the tubing 122 on a first longitudinal side of the second packer 126. In the example well tool 118, the first longitudinal side of the second packer 126 is a downhole side of the second packer 126. In the example well system 100 of FIG. 1, a first longitudinal side generally refers to a longitudinally downhole side, and a second longitudinal side generally refers to a longitudinally uphole side. The circulation sub 128 aids in controlling a pressure in the circulation fluid pathway, and in controlling the flow of fluid through the example well tool 118. The circulation sub 128 includes a cylindrical housing 130 connected to or formed with the tubing 122 on the first longitudinal side of the lowermost packer (in this example, downhole of the second packer 126) of the example well tool 118, and a circulation port 132 formed through the housing 130. The circulation port 132 fluidly couples the circulation fluid pathway to the annulus of the wellbore 102 downhole of the second packer 126, or between the first packer 124 and the second packer 126. The annulus is defined by the space within the wellbore 102 radially between the well tool 118 and the wellbore wall(s). For example, a portion of the wellbore annulus can be defined by a space between a radially outer surface of the tubing 122 and an inner wall of the wellbore 102.

The circulation sub 128 also includes a plug seat 134 positioned in the fluid circulation pathway, and in some instances, downhole of the first circulation port 132. The plug seat 134 is shaped to receive a dropped plug, for example, dropped from the wellhead 104 at the surface 106, through the well tubing 116 and the fluid circulation pathway of the tubing 122, and to the circulation sub 128. The plug seat 134 can sealingly engage with a dropped plug, such as a ball, dart, or other type of plug, to seal the fluid circulation pathway from flow through the plug seat (for example, downhole of the circulation sub 128). Although the first circulation port 132 is shown as formed in the housing 130 of the circulation sub 128, in some instances, the first circulation port 132 can instead be formed in the tubing 122 uphole of the circulation sub 128. In some implementations, the circulation sub 128 includes a sliding sleeve valve formed within the housing 130 and coupled to the plug seat 134. The sliding sleeve valve can connect to the housing with one or more shear pins, a locking mandrel, a combination of these, or other features. The sliding sleeve valve acts to plug the first circulation port 132 from fluid flow through the first circulation port 132 (for example, between the fluid circulation pathway and the annulus), and following an engagement of a plug with the plug seat and a pressurization of the fluid circulation pathway, the sliding sleeve valve can slide within the circulation sub 128 to open the first circulation port 132 to fluid flow. In some implementations, the lock mandrel selectively secures the sliding sleeve valve in a first position that closes (or plugs) the first circulation port 132, or in a second position that opens the first circulation port 132 to fluid flow. In certain implementations, the lock mandrel secures the sliding sleeve in a third position that closes or plugs the first circulation port 132, for example, after the circulation port is opened in the second position of the sliding sleeve valve. For example, in operation of the sliding sleeve valve of the circulation sub 128, a first set of shear pins secure the sliding sleeve valve in the first position. Once the first set of shear pins are sheared at a first threshold shear force, the sliding sleeve valve moves to the second position. In some implementations, a second set of shear pins secures the sliding sleeve valve in the second position. Once the second set of shear pins are sheared at a second threshold shear force that is greater than the first threshold shear force, the sliding sleeve valve can move to the third position, where the sliding sleeve valve is secured in the third position by the lock mandrel, Thereby plugging the first circulation port 132 from fluid flow through the first circulation port 132.

The first circulation port 132 is shown as a single ported opening through the housing 130. However, the circulation port 132 can take other forms and include more than one opening. For example, the first circulation port 132 can include two or more openings radially disposed about the housing 130 (or tubing 122), The example well tool 118 isolates zones of the wellbore 102 with the leaks 120 using packers (for example, the first packer 124 and second packer 126), and opens circulation ports exposed to these zones to introduce cement or other sealant fluid to seal the leak(s) in the respective zone. In the example well system 100 of FIG. 1, the example well tool 118 isolates a downhole zone with the first leak **120*a* using the second packer 126, and isolates a central zone with the second leak 120*b* between the first packer 124 and second packer 126 with the two packers. The example well tool 118 also includes a second circulation port 136 in the tubing 122 in this central zone between the first packer 124 and the second packer 126. The second circulation port 136 fluidly couples the circulation fluid pathway to the annulus of the wellbore 102 downhole of the first packer (for example, between the first packer 124 and second packer 126) when opened. The second circulation port 136 includes a frangible cover that plugs, temporarily or selectively, the second circulation port 136. The frangible cover is a fluid-seal cover over the second circulation port 136 that is configured to rupture when exposed to a pressure in the circulation fluid pathway that is greater than a burst pressure threshold of the frangible cover. For example, the frangible cover can have a burst pressure threshold of 1500 pounds per square inch (psi), such that the frangible cover can withstand pressures up to 1500 psi, but bursts, ruptures, or otherwise breaks the fluid seal when exposed to pressures greater than 1500 psi. This burst pressure threshold can vary, for example, based on materials used and design parameters of the example well tool 118**. The frangible cover can include ceramic material, or other materials.

During operation of the example well tool 118, a plug can engage the plug seat 134 to pressurize the circulation fluid pathway. The packers 124, 126, first circulation port 132, and second circulation port 136 all activate at different pressures in the circulation fluid pathway, for example, to allow the well tool 118 to undergo a sequence of cementing operations at sequentially increasing pressures. For example, with a dropped plug engaged with the plug seat 134, the circulation fluid pathway can be pressurized from the surface 106 (for example, from the wellhead 104) to a first threshold pressure to set (simultaneously or sequentially) the first packer 124 and the second packer 126, to a second pressure threshold to open the first circulation port 132, and to a third pressure threshold to open the second circulation port 136. Between these pressurizing operations, cementing operations can be performed to flow cement or other sealing fluid through the circulation fluid pathway and out of the first circulation port 132, then the second circulation port 136. These operations are described in greater detail later.

The downhole well tool 118 connects to the tubing string 116 at an uphole end of the downhole well tool 118. In some implementations, the downhole well tool 118 includes a disconnect sub 138 uphole of the first packer 124, which allows the downhole well tool 118 to disconnect from the tubing string 116 uphole of the well tool 118. The disconnect sub 138 can include a shaped profile or locking mechanism that can be activated by a stinger or other activation assembly, for example, to initiate a disconnection of the well tool 118 from the tubing string 116.

In some examples, such as in the example well system 100 of FIG. 1, a bridge plug 140 is disposed in the wellbore 102 downhole of the example well tool 118, for example, to isolate cementing fluid or other fluid from flowing further downhole, such as into a bottom hole assembly. The optional bridge plug 140 can be utilized, for example, to reduce a size of the isolation zone downhole of the second packer 126 during the cementing operation. In some instances, a high-viscosity pill 142 is disposed in the wellbore 102 adjacent to and uphole of the bridge plug 140. The viscous pill 142 acts as a buffer material between a cementing fluid and the bridge plug 140. The pill 142 has a high viscosity with a greater density than cement, for example, to avoid settling of cement above the retrievable bridge plug 140. In other implementations, the pill 142 includes sand material above the retrievable bridge plug 140 instead of or in addition to the high-viscosity material to hold any settled cement material and keep it from reaching the bridge plug 140.

The example well tool 118 can be drilled out, for example, by a drill string, after the sealing operations are completed and the downhole well tool 118 is disconnected from the tubing string 116. In some implementations, the tubing 122 includes non-metallic, drillable pipe. The non-metallic drillable pipe can connect to and extend between the first packer 124 and the second packer 126, can extend downhole of the second packer 126, or both. In certain implementations, the first packer 124, the second packer 126, or both, are drillable packers. For example, the first packer 124 and second packer 126 are brass packers with a fiberglass body, brass sliding valve, and a sealing element around the body. These brass packers are more easily drillable than other packers made from denser, more metallic materials that are more difficult to drill through.

Figure 2:
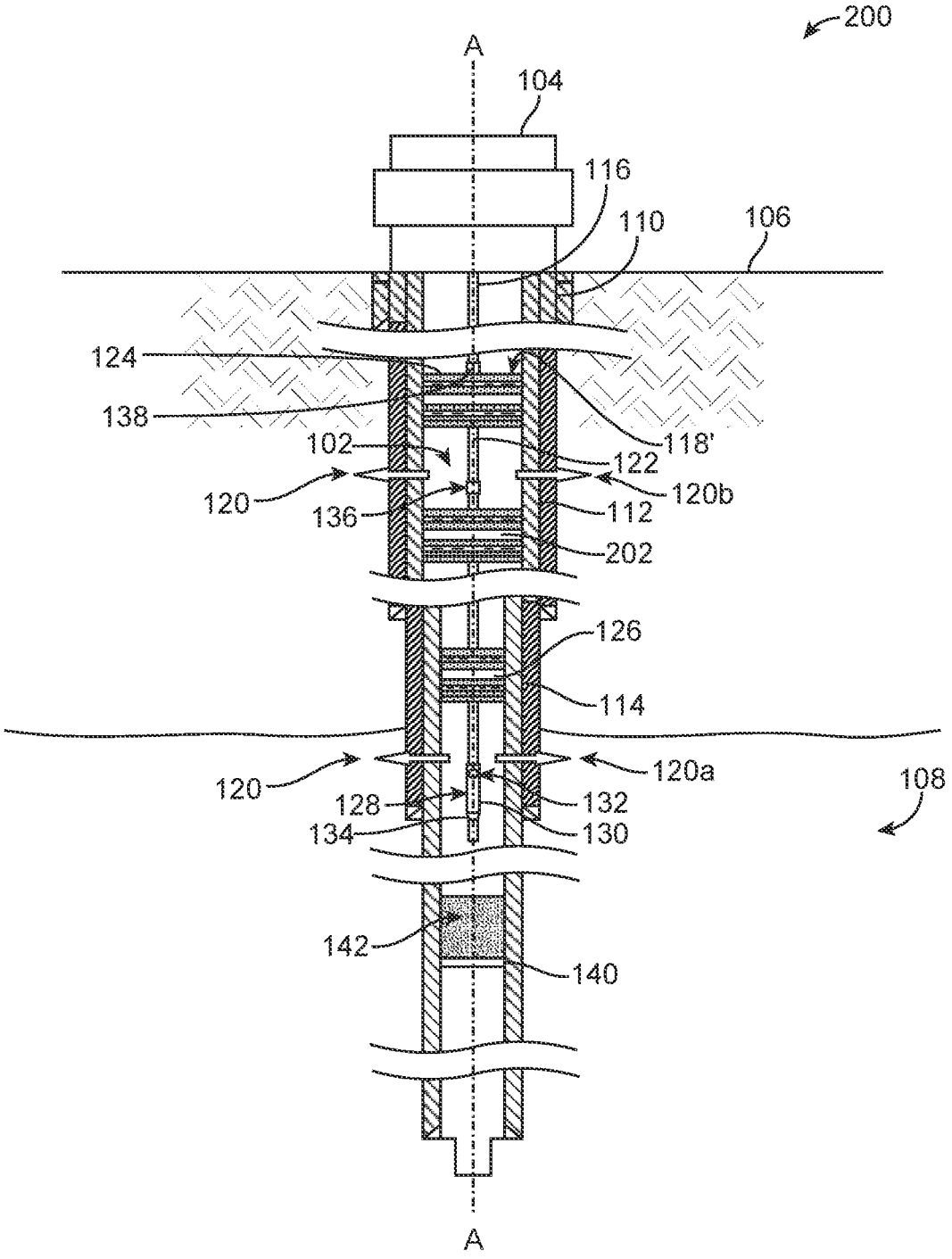
FIG. 2 is a schematic partial cross-sectional side view of a second example well system including a second downhole well tool carried on a well string.

The example well tool 118 is shown as having two packers, with the circulation sub 128 downhole of the second (lowermost) packer 126, and a second circulation port 136 positioned along the tubing 122 between the first packer 124 and second packer. However, the number of packers, the number of circulation ports, or both, can vary. In some implementations, the well tool 118 can include one or more additional packers, one or more additional circulation ports, or both. For example, FIG. 2 is a schematic partial cross-sectional side view of a second example well system 200 including a second downhole well tool 118'. The second example well system 200 is the same as the example well system 100 of FIG. 1, except that the second example well tool 118' includes a third packer 202 positioned between the second packer 126 and the second circulation port 136. In this second example well system 200, the isolation zone between the first packer 124 and the third packer 202 is more localized on the second leak 120*b*. The smaller isolation zone can help reduce an amount of cementing fluid used during a cementing operation, among other benefits.

Figure 3:
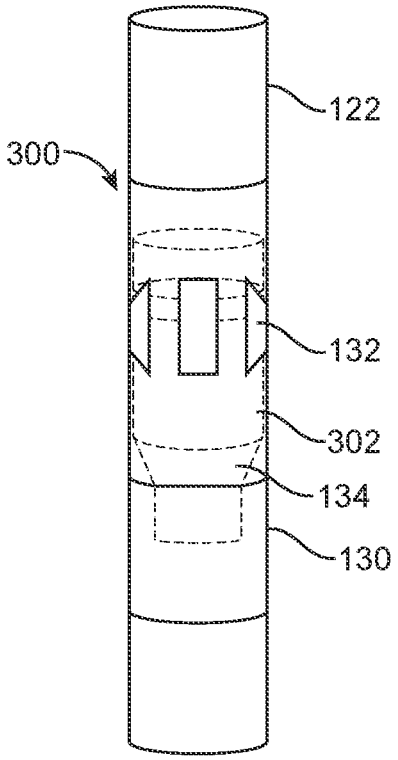
FIG. 3 is a partial schematic front view of an example circulation sub on a tubing.

FIG. 3 is a partial schematic front view of an example circulation sub 300 on a tubing 122. The example circulation sub 300 is the same as the circulation sub 128 of the example well tool 118 of FIG. 1, and can be used in the example well tool 118 of FIG. 1. The cylindrical housing 130 of the example circulation sub 300 is connected to or formed with the tubing 122, and the circulation port 132 is formed through the housing 130. The plug seat 134 is positioned in the fluid circulation pathway and downhole of the first circulation port 132. The plug seat 134 is shaped to receive a dropped plug, and is formed in a sliding sleeve 302 positioned within the housing 130. The sliding sleeve 302 can be secured to the housing 130 temporarily by shear pins (for example, the first set of shear pins at the first position and the second set of shear pins at the second position) or other frangible connection, and can also include a shoulder portion for engagement with a corresponding shoulder of the housing 130. These shoulder portions can prevent over-translation of the sliding sleeve 302 during operation.

Figure 4:
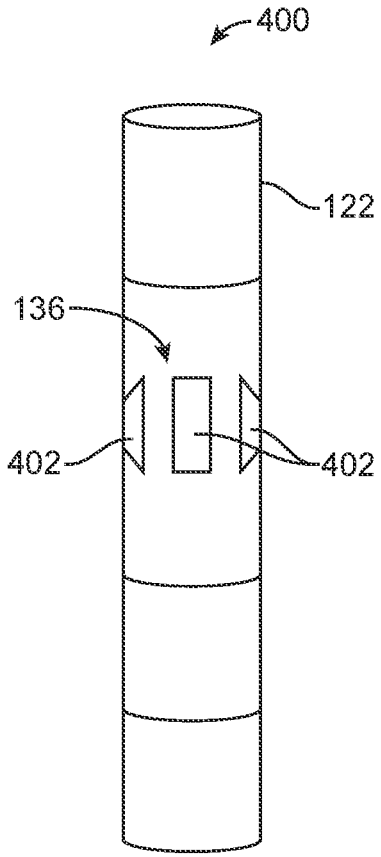
FIG. 4 is a partial schematic front view of an example circulation port on a tubing.

FIG. 4 is a partial schematic front view of an example circulation port 400 on a tubing 122, including the second circulation port 136 of the example well system 100 of FIG. 1. The example circulation port 400 can be used in the example well tool 118 of FIG. 1. The second circulation port 136 includes a frangible cover 402 that plugs, temporarily or selectively, the openings of the second circulation port 136. The frangible cover 402 is a fluid-seal cover over the second circulation port 136 that is configured to rupture when exposed to a pressure in the circulation fluid pathway that is greater than a burst pressure threshold of the frangible cover 402, as described earlier. For example, the frangible cover 402 can have a burst pressure threshold, where the frangible cover 402 can withstand pressures up to the burst pressure threshold, but bursts, ruptures, or otherwise breaks the fluid seal when exposed to pressures greater than the burst pressure threshold. This burst pressure threshold can vary, for example, based on materials used and design parameters of the example well tool 118.

Operation of the example well tool 118 includes sequential operations of pressurization and fluid injection using the circulation sub 128 and circulation ports. In some implementations, an operation of the example well tool 118 of the example well system 100 of FIG. 1 includes disposing the example well tool 118 in the wellbore 102 such that the packers are positioned to surround the casing leaks 120, for example, such that the first leak 120*a* is positioned between the second packer 126 and the bridge plug 140, and the second leak 120*b* is positioned between the first packer 124 and the second packer 126. In some examples, the first circulation port 132 is positioned near the first casing leak 120*a* and the second circulation port 136 is positioned near the second casing leak 120*b*. A plug, or ball, is dropped from the surface, and sealingly seats in the plug seat 134 of the circulation sub 128. The circulation fluid pathway is pressurized to a first pressure threshold, and the first packer 124 and second packer 126 are simultaneously set. In some instances, the first pressure threshold is about 1,000 psi. However, the first pressure threshold can vary.

Next, a pressure in the circulation fluid pathway is increased, for example, using mud pumps or other pressurizer(s), to a second pressure threshold to open the first circulation port 132. The second pressure threshold is greater than the first pressure threshold. In some instances, the second pressure threshold is about 1,300 psi, though this second pressure threshold can vary. A drop in the pumping pressure can signify that the first circulation port 132 has been opened, and in some instances, injectivity tests can be performed to ensure wellbore integrity. In some examples, at the second pressure threshold, the sliding sleeve valve is translated from its first position to its second position to open the first circulation port 132. With the first circulation port 132 opened and the second circulation port 136 remaining closed, a cementing fluid is pumped through the first circulation port 132 into the annulus downhole of the second packer 126 and toward the first leak 120*a*. Cement is squeezed into the leak 120*a* to cure this leak 120*a*.

In some implementations, once the first leak 120*a* is cured, the pressure in the circulation fluid pathway can be increased (for example, increased by about 200 psi) to a lock-up pressure greater than the second pressure threshold. At this lock-up pressure, additional shear pins on the sliding sleeve valve can shear in order to translate the sliding sleeve valve once again to close the first circulation port 132.

Figure 5:
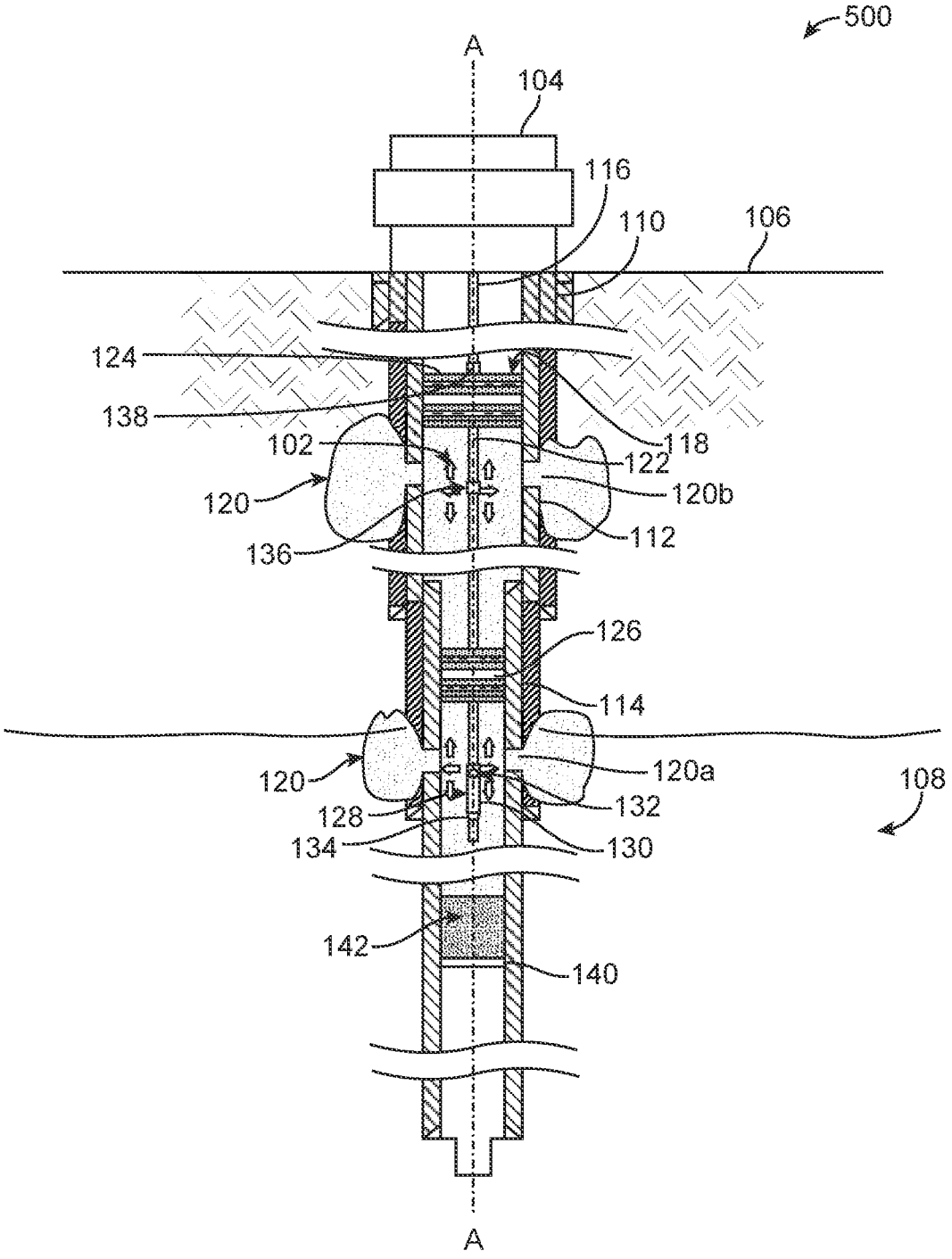
FIG. 5 is a schematic partial cross-sectional side view of the example well system of FIG. 1 during a cementing operation.

FIG. 5 is a schematic partial cross-sectional side view of an example well system 500 during a cementing operation. The example well system 500 is the same as the example well system 100 of FIG. 1, except that the example well system 500 is shown partway through a cementing operation. As depicted in FIG. 5, operation of the example well tool 118 can further include increasing the pressure in the circulation fluid pathway to a third pressure threshold that is greater than the second pressure threshold and greater than or equal to the burst pressure threshold of the second circulation port 136. At the third pressure threshold, the frangible cover ruptures and the second circulation port 136 is opened. In some instances, the third second pressure threshold is about 1,500 psi, though this third pressure threshold can vary. A drop in the pumping pressure in the circulation fluid pathway can signify that the second circulation port 136 has been opened, and in some instances, injectivity tests can be performed to ensure wellbore integrity. With the second circulation port 136 opened, a cementing fluid is pumped through the second circulation port 136 into the annulus between the first packer 124 and the second packer 126 and toward the second leak 120*b*. Cement is squeezed into the leak 120*b* to cure this leak 120*b*.

In some implementations, the example well system 100, 500 can include additional packers, circulation valves, or both, to preform additional cementing operations simultaneously or sequentially to seal multiple leaks in the wellbore 102 in a single run of the example well tool 118. After the cementing operations are complete and the leaks 120 are all sealed, the example well tool 118 can be disconnected from the well string 116 and drilled out, for example, to allow continuation of production, drilling, or other operations of the well. In some implementations, the disconnect sub 138 can disconnect the well tool 118 from the tubing string 116, and the tubing string 116 can be removed from the wellbore 102 while the well tool 118 remains in-hole. For example, a stinger from the first packer 124 can act to reverse out excess cement from the tubing string 116, and the tubing string 116 can be pulled out of the wellbore 102. Once the tubing string 116 is removed, the well tool 118 can be drilled out.

Figure 6:
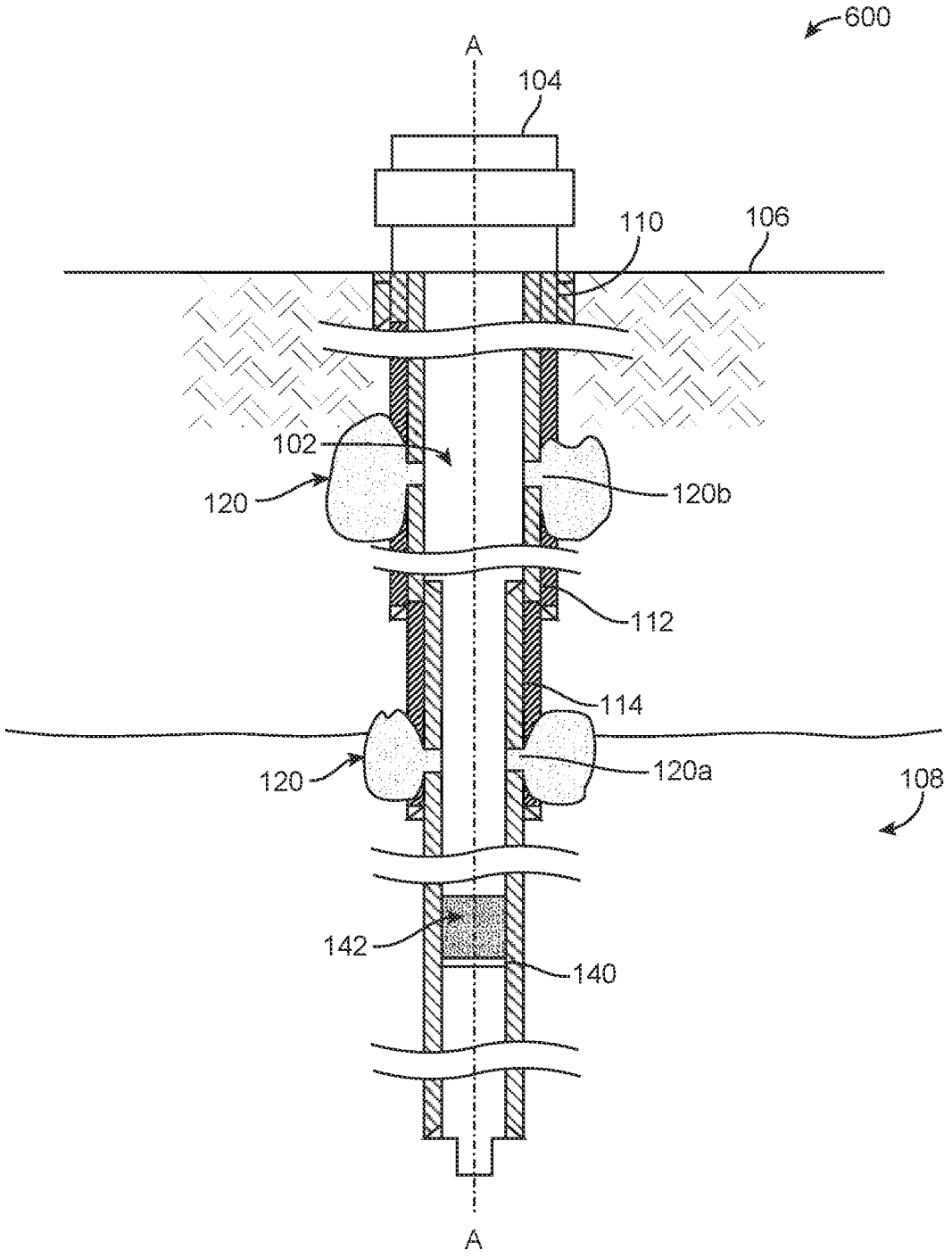
FIG. 6 is a schematic partial cross-sectional side view of the example well system 100 of FIG. 1 after a drilling operation.

FIG. 6 is a schematic partial cross-sectional side view of an example well system 600 after a drilling operation. The example well system 600 is the same as the example well system 100 of FIG. 1, except that the example well system 600 is shown following a drilling operation to remove the well tool 118 (no longer shown). For example, after the well tool 118 is disconnected from the tubing string 116 and left in hole, a drill string can drill through the well tool 118. Since the components of the example well tool 118 are drillable, the drill string can readily drill through the well tool 118 without compromising the sealed leaks 120 sealed by the well tool 118. As depicted in the example well system 600 of FIG. 6, the leaks 120 are sealed and the wellbore 102 is ready for further operations. In some implementations, the wellbore 102 can be pressure tested to confirm that the leaks 120 are sufficiently sealed and holding their seal.

Figure 7:
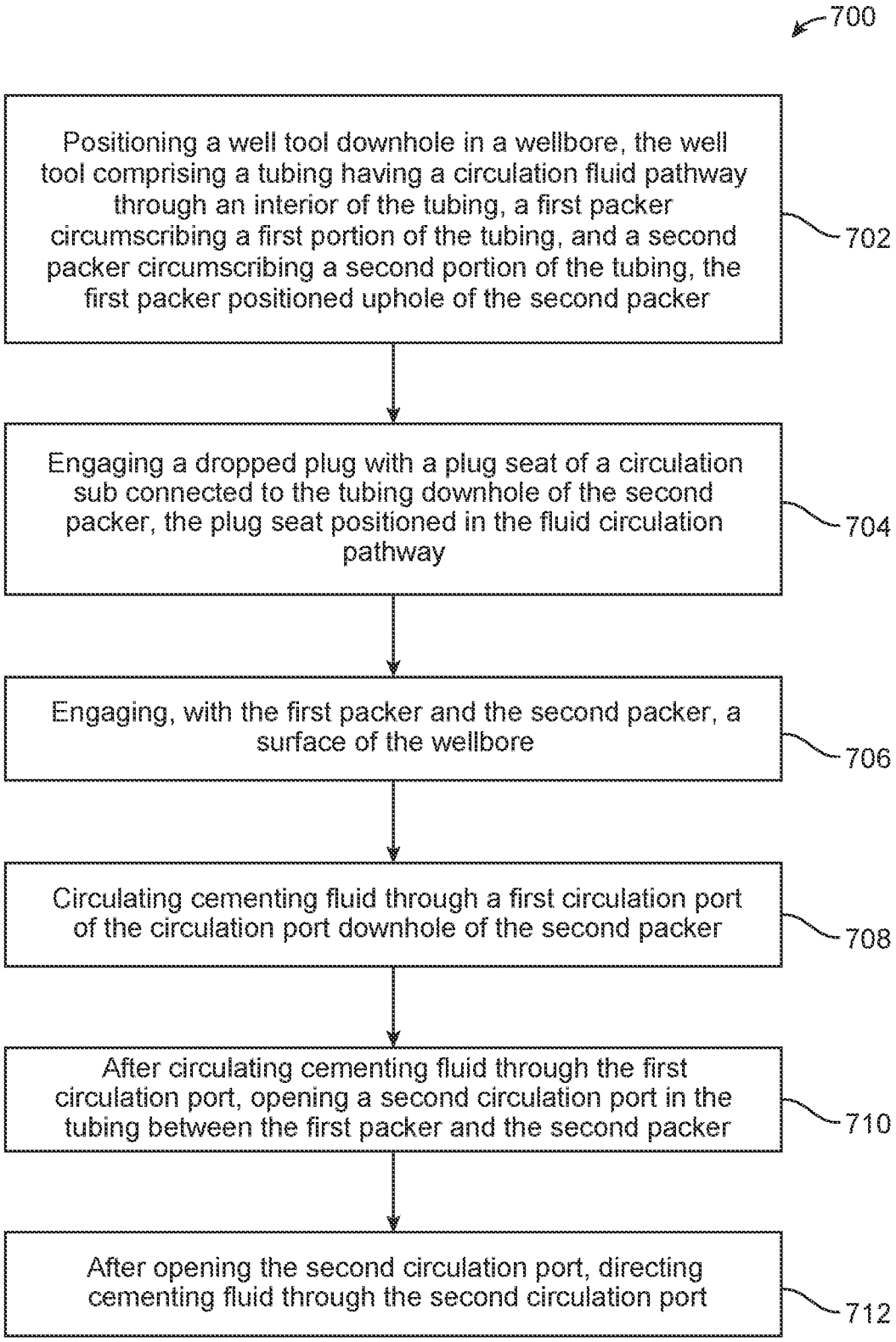
FIG. 7 is a flowchart describing an example method for sealing leaks in a wellbore.

FIG. 7 is a flowchart describing an example method 700 for sealing leaks in a wellbore, for example, performed by the example downhole well tool 118 of the example well system 100 of FIG. 1 or the example downhole well tool 118' of the example well system 200 of FIG. 2. At 702, a well tool is positioned downhole in a wellbore. The well tool includes a tubing having a circulation fluid pathway through an interior of the tubing, a first packer circumscribing a first portion of the tubing, and a second packer circumscribing a second portion of the tubing, and the first packer is positioned uphole of the second packer. At 704, a dropped plug engages with a plug seat of a circulation sub connected to the tubing downhole of the second packer. The plug seat is positioned in the fluid circulation pathway. At 706, the first packer and the second packer engage a surface of the wellbore. At 708, cementing fluid is circulated through a first circulation port of the circulation port downhole of the second packer. At 710, after circulating cementing fluid through the first circulation port, a second circulation port is opened in the tubing between the first packer and the second packer. At 712, after opening the second circulation port, cementing fluid is directed through the second circulation port.

EXAMPLES

In a first aspect, a downhole well tool comprises a tubing configured to be disposed in a wellbore along a longitudinal axis of the tubing, the tubing comprising a circulation fluid pathway through an interior of the tubing, a first packer circumscribing a first portion of the tubing, and a second packer circumscribing a second portion of the tubing. The first packer is positioned longitudinally apart from the second packer on the tubing, and the first packer and the second packer are configured to selectively engage and seal against a wall of the wellbore. The downhole well tool further comprises a circulation sub connected to the tubing on a first longitudinal side of the second packer, and the circulation sub comprises a first circulation port configured to fluidly couple the circulation fluid pathway to an annulus of the wellbore on the first longitudinal side of the second packer; and a plug seat positioned in the fluid circulation pathway, the plug seat configured to seal against a dropped plug within the tubing. The downhole well tool further comprises a second circulation port in the tubing longitudinally between the first packer and the second packer and configured to fluidly couple the circulation fluid pathway to the annulus of the wellbore between the first packer and the second packer, the second circulation port comprising a frangible cover to selectively plug the second circulation port, the frangible cover configured to rupture in response to a pressure in the circulation fluid pathway greater than a burst pressure threshold.

In a second aspect according to the first aspect, the tubing comprises non-metallic, drillable pipe connected to and extending between the first packer and the second packer.

In a third aspect according to the first aspect or the second aspect, the first packer and the second packer are drillable packers.

In a fourth aspect according to the third aspect, the first packer and the second packer are brass packers comprising a fiberglass body, brass sleeve, and a sealing element around the fiberglass body.

In a fifth aspect according to any one of the first aspect to the fourth aspect, the circulation sub further comprises a sliding sleeve valve configured to selectively plug the first circulation port from fluid flow through the first circulation port, the plug seat is coupled to the sliding sleeve valve, and the sliding sleeve valve is configured to slide within the circulation sub and open the first circulation port to fluid flow in response to the dropped plug engaging the plug seat at a first pressure threshold.

In a sixth aspect according to the fifth aspect, the circulation sub further comprises a lock mandrel configured to selectively secure the sliding sleeve valve in a first position to close the first circulation port or a second position to open the first circulation port.

In a seventh aspect according to any one of the first aspect to the sixth aspect, the downhole well tool further comprises a third packer circumscribing a third portion of the tubing, the third packer positioned between the second circulation port and the second packer.

In an eighth aspect according to any one of the first aspect to the seventh aspect, the tubing comprises a disconnect sub on a second longitudinal side of the first packer, the disconnect sub configured to disconnect the downhole well tool from a well string adjacent the second longitudinal side of the first packer.

In a ninth aspect according to any one of the first aspect to the eighth aspect, the frangible cover of the second circulation port comprises ceramic.

In a tenth aspect, a method comprises positioning a well tool downhole in a wellbore, the well tool comprising a tubing having a circulation fluid pathway through an interior of the tubing, a first packer circumscribing a first portion of the tubing, and a second packer circumscribing a second portion of the tubing, the first packer positioned uphole of the second packer; engaging a dropped plug with a plug seat of a circulation sub connected to the tubing downhole of the second packer, the plug seat positioned in the fluid circulation pathway; engaging, with the first packer and the second packer, a surface of the wellbore; circulating cementing fluid through a first circulation port of the circulation port downhole of the second packer; after circulating cementing fluid through the first circulation port, opening a second circulation port in the tubing between the first packer and the second packer; and after opening the second circulation port, directing cementing fluid through the second circulation port.

In an eleventh aspect according to the tenth aspect, the method comprises pressurizing the circulation fluid pathway to a first pressure threshold, and wherein engaging the surface of the wellbore with the first packer and the second packer occurs in response to pressurizing the circulation fluid pathway to the first pressure threshold.

In a twelfth aspect according to the eleventh aspect, the method further comprises, after engaging the surface of the wellbore with the first packer and the second packer, pressurizing the circulation fluid pathway to a second pressure threshold greater than the first pressure threshold, and in response to pressurizing the circulation fluid pathway to the second pressure threshold, causing a sliding sleeve valve of the circulation sub to move from a first, closed position to a second, open position within the circulation sub, the sliding sleeve valve comprising the plug seat.

In a thirteenth aspect according to the twelfth aspect, the method further comprises, after circulating cementing fluid through the first circulation port, moving the sliding sleeve valve to a third position to close the first circulation port.

In a fourteenth aspect according to the twelfth aspect or the thirteenth aspect, opening the second circulation port comprises rupturing a frangible cover over the second circulation port.

In a fifteenth aspect according to the fourteenth aspect, rupturing the frangible cover comprises pressurizing the circulation fluid pathway to a third pressure threshold greater than a pressure capacity of the frangible cover and greater than the second pressure threshold.

In a sixteenth aspect according to any one of the tenth aspect to the fifteenth aspect, the method further comprises disconnecting, at a disconnect sub uphole of the first packer, the well tool from a well string uphole of the first packer.

In a seventeenth aspect according to the sixteenth aspect, the method further comprises drilling out the well tool, wherein the tubing comprises non-metallic, drillable pipe connected to and extending between the first packer and the second packer, and the first packer and the second packer are drillable brass packers.

In an eighteenth aspect according to the seventeenth aspect, the method further comprises pressure testing the wellbore.

In a nineteenth aspect, a well system comprises a bridge plug configured to be disposed in a wellbore; a viscous pill configured to be disposed in the wellbore adjacent to and on a first longitudinal side of the bridge plug, and a downhole well tool configured to be positioned longitudinally apart from the viscous pill and along a longitudinal axis of the downhole well tool, the downhole well tool comprising: a tubing comprising a circulation fluid pathway through an interior of the tubing; a first packer circumscribing a first portion of the tubing, and a second packer circumscribing a second portion of the tubing, the first packer positioned longitudinally apart from of the second packer on the tubing; a circulation sub connected to the tubing on a first longitudinal side of the second packer, the circulation sub comprising a first circulation port configured to fluidly couple the circulation fluid pathway to an annulus of the wellbore on the first longitudinal side of the second packer, and a plug seat positioned in the fluid circulation pathway, the plug seat configured to seal against a dropped plug within the tubing; and a second circulation port in the tubing longitudinally between the first packer and the second packer and configured to fluidly couple the circulation fluid pathway to the annulus of the wellbore between the first packer and the second packer.

In a twentieth aspect according to the nineteenth aspect, the second circulation port comprises a frangible cover to selectively plug the second circulation port, the frangible cover configured to rupture in response to a pressure in the circulation fluid pathway greater than a burst pressure threshold.

While this disclosure contains many specific implementation details, these should not be construed as limitations on the scope of what may be claimed, but rather as descriptions of features specific to particular implementations. Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the implementations described above should not be understood as requiring such separation in all implementations, and it should be understood that the described components and systems can generally be integrated together in a single product or packaged into multiple products.

Thus, particular implementations of the subject matter have been described. Other implementations are within the scope of the following claims. Various modifications may be made without departing from the spirit and scope of the disclosure. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A downhole well tool, comprising:

a tubing configured to be disposed in a wellbore along a longitudinal axis of the tubing, the tubing comprising a circulation fluid pathway through an interior of the tubing;

a first packer circumscribing a first portion of the tubing, and a second packer circumscribing a second portion of the tubing, the first packer positioned longitudinally apart from the second packer on the tubing, and the first packer and the second packer configured to selectively engage and seal against a wall of the wellbore;

a circulation sub connected to the tubing on a first longitudinal side of the second packer, the circulation sub comprising:

a first circulation port configured to fluidly couple the circulation fluid pathway to an annulus of the wellbore on the first longitudinal side of the second packer; and a plug seat positioned in the fluid circulation pathway, the plug seat configured to seal against a dropped plug within the tubing; and a second circulation port in the tubing longitudinally between the first packer and the second packer and configured to fluidly couple the circulation fluid pathway to the annulus of the wellbore between the first packer and the second packer, the second circulation port comprising a frangible cover to selectively plug the second circulation port, the frangible cover configured to rupture in response to exposure to a pressure in the circulation fluid pathway greater than a burst pressure threshold.

2. The downhole well tool of claim 1, wherein the tubing comprises non-metallic, drillable pipe connected to and extending between the first packer and the second packer.

3. The downhole well tool of claim 2, wherein the first packer and the second packer are drillable packers.

4. The downhole well tool of claim 3, wherein the first packer and the second packer are brass packers comprising a fiberglass body, brass sleeve, and a sealing element around the fiberglass body.

5. The downhole well tool of claim 1, wherein:

the circulation sub further comprises a sliding sleeve valve configured to selectively plug the first circulation port from fluid flow through the first circulation port, the plug seat is coupled to the sliding sleeve valve, and the sliding sleeve valve is configured to slide within the circulation sub and open the first circulation port to fluid flow in response to the dropped plug engaging the plug seat at a first pressure threshold.

6. The downhole well tool of claim 5, wherein the circulation sub further comprises a lock mandrel configured to selectively secure the sliding sleeve valve in a first position to close the first circulation port or a second position to open the first circulation port.

7. The downhole well tool of claim 1, further comprising a third packer circumscribing a third portion of the tubing, the third packer positioned between the second circulation port and the second packer.

8. The downhole well tool of claim 1, wherein the tubing comprises a disconnect sub on a second longitudinal side of the first packer, the disconnect sub configured to disconnect the downhole well tool from a well string adjacent the second longitudinal side of the first packer.

9. The downhole well tool of claim 1, wherein the frangible cover of the second circulation port comprises ceramic.

10. A method, comprising:

positioning a well tool downhole in a wellbore, the well tool comprising a tubing having a circulation fluid pathway through an interior of the tubing, a first packer circumscribing a first portion of the tubing, and a second packer circumscribing a second portion of the tubing, the first packer positioned uphole of the second packer;

engaging a dropped plug with a plug seat of a circulation sub connected to the tubing downhole of the second packer, the plug seat positioned in the fluid circulation pathway;

engaging, with the first packer and the second packer, a surface of the wellbore;

circulating cementing fluid through a first circulation port of the circulation port downhole of the second packer;

after circulating cementing fluid through the first circulation port, opening a second circulation port in the tubing between the first packer and the second packer, wherein opening the second circulation port comprises rupturing a frangible cover over the second circulation port in response to exposure to a pressure in the circulation fluid pathway greater than a burst pressure threshold of the frangible cover; and after opening the second circulation port, directing cementing fluid through the second circulation port.

11. The method of claim 10, comprising pressurizing the circulation fluid pathway to a first pressure threshold, and wherein engaging the surface of the wellbore with the first packer and the second packer occurs in response to pressurizing the circulation fluid pathway to the first pressure threshold.

12. The method of claim 11, further comprising:

after engaging the surface of the wellbore with the first packer and the second packer, pressurizing the circulation fluid pathway to a second pressure threshold greater than the first pressure threshold, and in response to pressurizing the circulation fluid pathway to the second pressure threshold, causing a sliding sleeve valve of the circulation sub to move from a first, closed position to a second, open position within the circulation sub, the sliding sleeve valve comprising the plug seat.

13. The method of claim 12, further comprising:

after circulating cementing fluid through the first circulation port, moving the sliding sleeve valve to a third position to close the first circulation port.

14. The method of claim 12, wherein rupturing the frangible cover comprises pressurizing the circulation fluid pathway to a third pressure threshold greater than a pressure capacity of the frangible cover and greater than the second pressure threshold.

15. The method of claim 10, further comprising disconnecting, at a disconnect sub uphole of the first packer, the well tool from a well string uphole of the first packer.

16. The method of claim 15, further comprising drilling out the well tool, wherein the tubing comprises non-metallic, drillable pipe connected to and extending between the first packer and the second packer, and the first packer and the second packer are drillable brass packers.

17. The method of claim 16, further comprising pressure testing the wellbore.

18. A well system, comprising:

a bridge plug configured to be disposed in a wellbore;

a viscous pill configured to be disposed in the wellbore adjacent to and on a first longitudinal side of the bridge plug; and a downhole well tool configured to be positioned longitudinally apart from of the viscous pill and along a longitudinal axis of the downhole well tool, the downhole well tool comprising:

a tubing comprising a circulation fluid pathway through an interior of the tubing;

a first packer circumscribing a first portion of the tubing, and a second packer circumscribing a second portion of the tubing, the first packer positioned longitudinally apart from the second packer on the tubing;

a circulation sub connected to the tubing on a first longitudinal side of the second packer, the circulation sub comprising:

a first circulation port configured to fluidly couple the circulation fluid pathway to an annulus of the wellbore on the first longitudinal side of the second packer; and a plug seat positioned in the fluid circulation pathway, the plug seat configured to seal against a dropped plug within the tubing; and a second circulation port in the tubing longitudinally between the first packer and the second packer and configured to fluidly couple the circulation fluid pathway to the annulus of the wellbore between the first packer and the second packer, the second circulation port comprising a frangible cover to selectively plug the second circulation port, the frangible cover configured to rupture in response to exposure to a pressure in the circulation fluid pathway greater than a burst pressure threshold.

* * * * *